US008022335B2

(12) United States Patent
Burton et al.

(10) Patent No.: US 8,022,335 B2
(45) Date of Patent: Sep. 20, 2011

(54) RAPID WARM-UP AND COOL-DOWN PRESSURE ROLL ASSEMBLY AND A FUSING APPARATUS INCLUDING SAME

(75) Inventors: William A Burton, Rochester, NY (US); Lawrence A Clark, Webster, NY (US); Paul M Fromm, Rochester, NY (US); Melissa A Monahan, Rochester, NY (US); Steven M Russel, East Bloomfield, NY (US); Stephen B Williams, Marion, NY (US); Brendan H Williamson, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 942 days.

(21) Appl. No.: 11/609,478

(22) Filed: Dec. 12, 2006

(65) Prior Publication Data

US 2008/0138102 A1 Jun. 12, 2008

(51) Int. Cl.
*G03G 15/20* (2006.01)

(52) U.S. Cl. ..... 219/216; 399/69; 399/330; 399/333

(58) Field of Classification Search ..... None
See application file for complete search history.

(56) References Cited

U.S. PATENT DOCUMENTS

| | | | | |
|---|---|---|---|---|
| 3,601,887 | A * | 8/1971 | Mitchell et al. | 438/55 |
| 3,937,028 | A | 2/1976 | Alais | |
| 4,977,431 | A | 12/1990 | Fuji | |
| 5,247,336 | A * | 9/1993 | Mills, III | 399/70 |
| 5,740,513 | A * | 4/1998 | Matsuo et al. | 399/333 |
| 5,804,794 | A * | 9/1998 | Matsuo et al. | 219/216 |
| 5,812,906 | A * | 9/1998 | Staudenmayer et al. | 399/69 |
| 5,918,087 | A | 6/1999 | Kimura et al. | |
| 5,987,295 | A * | 11/1999 | Matsuo et al. | 399/330 |
| 5,991,564 | A | 11/1999 | Ni | |
| 6,064,850 | A * | 5/2000 | Matsuo et al. | 399/333 |
| 6,067,802 | A | 5/2000 | Alonso | |
| 6,072,156 | A * | 6/2000 | Matsuo et al. | 219/216 |
| 7,589,300 | B2 * | 9/2009 | Nojima | 219/619 |
| 7,765,811 | B2 * | 8/2010 | Hershberger et al. | 62/3.5 |
| 2003/0099478 | A1 * | 5/2003 | Okano | 399/69 |
| 2004/0202491 | A1 * | 10/2004 | Sakai et al. | 399/69 |
| 2005/0139250 | A1 * | 6/2005 | DeSteese et al. | 136/212 |
| 2009/0282852 | A1 * | 11/2009 | Venkatasubramanian et al. | 62/259.2 |
| 2010/0021194 | A1 * | 1/2010 | Toyohara et al. | 399/69 |
| 2010/0080634 | A1 * | 4/2010 | Kimura | 399/329 |

* cited by examiner

*Primary Examiner* — Joseph M Pelham

(74) *Attorney, Agent, or Firm* — Matthew C. Loppnow; PRASS LLP

(57) ABSTRACT

A rapid warm-up and cool-down pressure roll assembly is provided and includes (a) a rotatable pressure roll including a cylindrical sleeve having an outer surface, and an inner surface defining a hollow interior to the rotatable pressure roll; (b) a thermoelectric assembly sheet positioned within the hollow interior and having a first substrate facing the inner surface of the cylindrical sleeve, a second substrate, an electric current flow path therethrough, and electric current input and output terminals associated with the electric current flow path; and (c) an electric current input switching device connected to the electric current input and output terminals for enabling selective reversing of a direction of electric current flow through the electric current flow path, thereby reversing which of the first substrate and the second substrate of the thermoelectric assembly sheet is hot and which is cold, and therefore selectively enabling a rapid warm-up or rapid cool-down of the cylindrical sleeve of the pressure roll.

19 Claims, 3 Drawing Sheets

RAPID WARM-UP AND COOL-DOWN PRESSURE ROLL ASSEMBLY AND A FUSING APPARATUS INCLUDING SAME

The present invention relates to an electrostatographic reproducing machine and, more particularly, to such a machine including a fusing apparatus having a rapid warm-up and cool-down pressure roll assembly.

One type of electrostatographic reproducing machine is a xerographic copier or printer. In a typical xerographic copier or printer, a photoreceptor surface, for example that of a drum, is generally arranged to move in an endless path through the various processing stations of the xerographic process. As in most xerographic machines, a light image of an original document is projected or scanned onto a uniformly charged surface of a photoreceptor to form an electrostatic latent image thereon. Thereafter, the latent image is developed with an oppositely charged powdered developing material called toner to form a toner image corresponding to the latent image on the photoreceptor surface. When the photoreceptor surface is reusable, the toner image is then electrostatically transferred to a recording medium, such as paper, and the surface of the photoreceptor is cleaned and prepared to be used once again for the reproduction of a copy of an original. The paper with the powdered toner thereon in imagewise configuration is separated from the photoreceptor and moved through a fuser apparatus to permanently fix or fuse the toner image to the paper.

One approach to fixing, or "fusing", the toner image is applying heat and pressure by passing the copy sheet carrying the unfused toner image between a pair of opposed roller members of a fusing apparatus, at least one of the rollers is internally heated. During this procedure, the temperature of the toner material is elevated to a temperature at that the toner material coalesces and becomes tacky. This heating causes the toner to flow to some extent into the fibers or pores of the sheet. Thereafter, as the toner material cools, solidification of the toner material causes the toner material to become bonded to the sheet or substrate.

Dry ink or toner fusing apparatus use heat and pressure in a heated fuser and pressure roll arrangement, for example, to heat, melt and press-bond or fix the melted ink or toner onto the surface of a substrate or sheet. In such a fusing apparatus, the pressure roll needs to be initially heated along with the heated fuser roll in order to quickly warm up the fusing nip and thus reduce the time-to-first-print measure of the fusing apparatus. Subsequently however, in a duplexing machine that forms a first toner image on side 1 of the sheet (that is first fused in a first pass through the fusing nip), and a second toner image thereafter on side 2 of the sheet (that is fused subsequently during a second pass of the sheet through the fusing nip), the pressure roll may need to be cooled then (after such initial warm up heating) in order to avoid over fusing and related defects in the side 1 image. In such cases, it is believed improved pressure roll cooling will reduce the temperature of the sheet leaving the fusing nip, and thus will reduce such related over-fusing image defects.

Also in the case of simplex printing, cooling the pressure roll to below its unregulated temperature will allow control of the average or bulk sheet temperature. Modification of the bulk sheet temperature in this manner can have many benefits including reduction of image quality artifacts such as gloss streaks or spots. Additionally, lower bulk sheet temperatures also reduce heat load in the rest of the machine besides also making the sheets in the exit try more comfortable to handle.

As disclosed in the following patents, several other reasons have been advanced for desiring to control the temperatures of both the heated fuser roller and of the pressure roller in a roller fusing or fixing apparatus. The examples also show that the Peltier heating and cooling principles have been successfully adapted elsewhere for inventive heating and cooling applications. For example, U.S. Pat. No. 6,067,802 issued May 30, 2000 and entitled "Peltier effect heat pump" discloses a heat pump system based on the Peltier effect, built around a transparent or translucent material element and formed by two sheets (1) in which chains of thermoelements (3, 4) are embedded, trapped or inserted, said thermoelements being connected along their respective alternate ends with the aid of parts (2) made of a material with good thermal and electric conductivity properties, which chains are liable of being supplied with external electric energy so that heat transport is based on the direction of the current flowing through said thermoelements.

U.S. Pat. No. 3,937,028 issued Feb. 10, 1976 and entitled "Module for conditioning air by the Peltier effect and air conditioning installations comprising such modules" a Module for conditioning air by the Peltier effect, comprising a hot plate and a cold plate arranged face to face, divided into strip substrates and both provided with ribs, the P and N thermoelements connected by the strip substrates and arranged between the crests of the cold ribs and the crests of the hot ribs, the cold ribs are vertical and the hot ribs are vertical or horizontal. The air to be conditioned circulates by natural convection along the vertical ribs without forced ventilation.

U.S. Pat. No. 5,247,336 issued Sep. 21, 1993 and entitled "Image fusing apparatus having heating and cooling devices" discloses a fusing apparatus for fusing toner images onto a substrate. The fusing apparatus includes a heated first fusing member, a second timing member and a fusing mix formed by the first and second members. A substrate carrying an unfused toner image on a first side thereof is routed through the fusing nip such that the unfused toner image directly faces the heated first member, and the second side thereof directly faces the second fusing member. In order to prevent melting or remelting of a toner image on such second side, the fusing apparatus includes a device for cooling and maintaining the temperature of the second fusing member at a point below the melting temperature of toner particles forming the image on such second side.

U.S. Pat. No. 5,991,564 issued Nov. 23, 1999 and entitled "Electrophotographic duplex printing media system" discloses a method and system media sheet handling in an electrophotographic color desktop printer are disclosed wherein a media sheet is imaged with toner on both sides of the media sheet without smudging or re-melting the images. The temperature of the fusing roller and the pressure roller are controlled to keep the pressure roller temperature below the toner cold offset temperature.

U.S. Pat. No. 5,918,087 issued Jun. 29, 1999 and entitled "Image forming apparatus" discloses an image forming apparatus including a fixing roller and a pressure roller in which a temperature of the fixing roller and/or the pressure roller is changed differently depending on an operation mode. In particular, the temperature of the fixing roller and/or pressure roller of an operation of a non-full color mode is changed to a lesser degree than that of a full color mode operation. In another embodiment of the present invention, the temperature of the fixing roller is set to an appropriate value when an environment temperature sensor is not working properly, to produce high quality images. In yet another embodiment according to the present invention, the temperature of the fixing roller is set to an appropriate value, when an image forming apparatus is turned off for a predetermined period of time, to produce high quality images.

U.S. Pat. No. 4,977,431 issued December, 1990 and entitled "Fixing apparatus and method of controlling temperature of the same" discloses a fixing apparatus detects the surface temperature of a heat roller, detects either the temperature of a press roller which press-contacts the heat roller and incorporates a heater, or the temperature of an external heating apparatus which heats the exterior of the heat roller. The fixing apparatus controls the heater of the above-mentioned press roller or the above-mentioned external heating apparatus based on the results of these detections, and thereby performs a high-quality fixing operation without damaging the heat roller.

In accordance with the present disclosure, there has been provided a rapid warm-up and cool-down pressure roll assembly that includes (a) a rotatable pressure roll including a cylindrical sleeve having an outer surface, and an inner surface defining a hollow interior to the rotatable pressure roll; (b) a thermoelectric assembly sheet positioned within the hollow interior and having a first substrate facing the inner surface of the cylindrical sleeve, a second substrate, an electric current flow path therethrough, and electric current input and output terminals associated with the electric current flow path; and (c) an electric current input switching device connected to the electric current input and output terminals for enabling selective reversing of a direction of electric current flow through the electric current flow path, thereby reversing which of the first substrate and the second substrate of the thermoelectric assembly sheet is hot and which is cold, and therefore selectively enabling a rapid warm-up or rapid cool-down of the cylindrical sleeve of the pressure roll.

Figure 1:
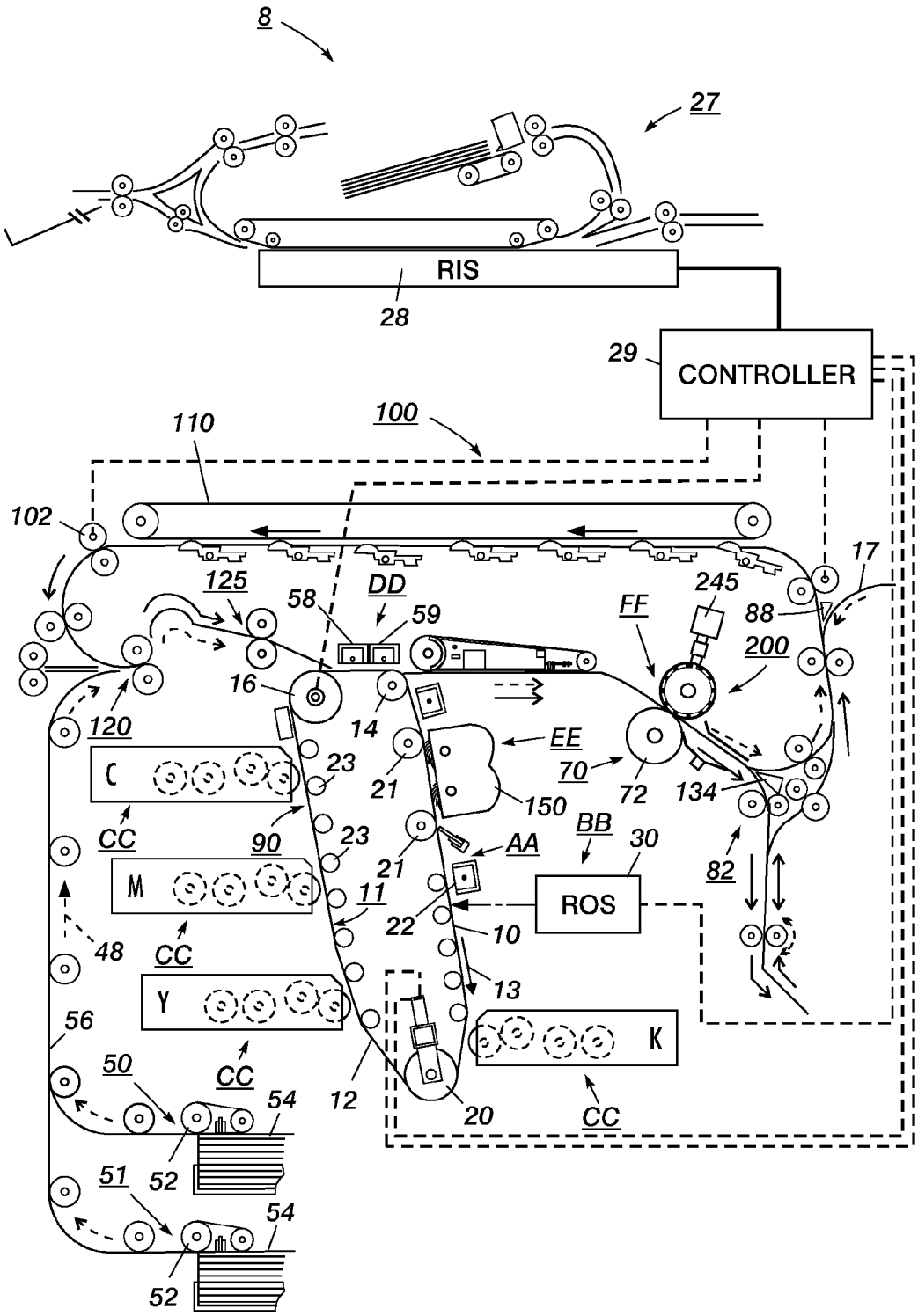
FIG. 1 is a schematic elevational view of an exemplary electrostatographic reproduction machine including a fusing apparatus having a rapid warm-up and cool-down pressure roll assembly in accordance with the present disclosure.

Referring first to FIG. 1, it schematically illustrates an electrostatographic reproduction machine 8 that generally employs a photoconductive belt 10 mounted on a belt support module 90. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop 11 about stripping roll 14, drive roll 16, idler roll 21, and backer rolls 23.

Initially, a portion of the photoconductive belt surface passes through charging station AA. At charging station AA, a corona-generating device indicated generally by the reference numeral 22 charges the photoconductive belt 10 to a relatively high, substantially uniform potential. As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine status information.

Still referring to FIG. 1, at an exposure station BB, the controller or electronic subsystem (ESS) 29, receives the image signals from RIS 28 representing the desired output image and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis. After the electrostatic latent image has been recorded on photoconductive surface 12, belt 10 advances the latent image through development stations CC, that include four developer units as shown, containing CMYK color toners, in the form of dry particles. At each developer unit the toner particles are appropriately attracted electrostatically to the latent image using commonly known techniques.

With continued reference to FIG. 1, after the electrostatic latent image is developed, the toner powder image present on belt 10 advances to transfer station DD. A print sheet 54 is advanced to the transfer station DD, by a sheet feeding apparatus 50. Sheet-feeding apparatus 50 may include a corrugated vacuum feeder (TCVF) assembly 52 for contacting the uppermost sheet 54 of stack 55. TCVF 52 acquires each top sheet 54 and advances it to vertical transport 56. Vertical transport 56 directs the advancing sheet 54 through feed rolls 120 into registration transport 125, then into image transfer station DD to receive an image from photoreceptor belt 10 in a timed and registered manner. Transfer station DD typically includes a corona-generating device 58 that sprays ions onto the backside of sheet 54. This assists in attracting the toner powder image from photoconductive surface 12 to sheet 54. After transfer, sheet 54 continues to move in the direction of arrow 60 where it is picked up by a pre-fuser transport assembly and forwarded to fusing station FF. Fusing station FF includes the fusing apparatus 70 that has the rapid warm-up and cool-down pressure roll assembly 200 of the present disclosure (to be described in detail below), and is suitable for fusing and permanently affixing the transferred toner powder image 213 to the copy sheet 54.

After fusing and permanently affixing the transferred toner powder image 213, the sheet 54 then passes to a gate 88 that either allows the sheet to move directly via output 17 to a finisher or stacker, or deflects the sheet into the duplex path 100. Specifically, the sheet (when to be directed into the duplex path 100), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles still on and may be adhering to photoconductive surface 12 are then removed there from by a cleaning apparatus 150 at cleaning station EE.

Figure 2:
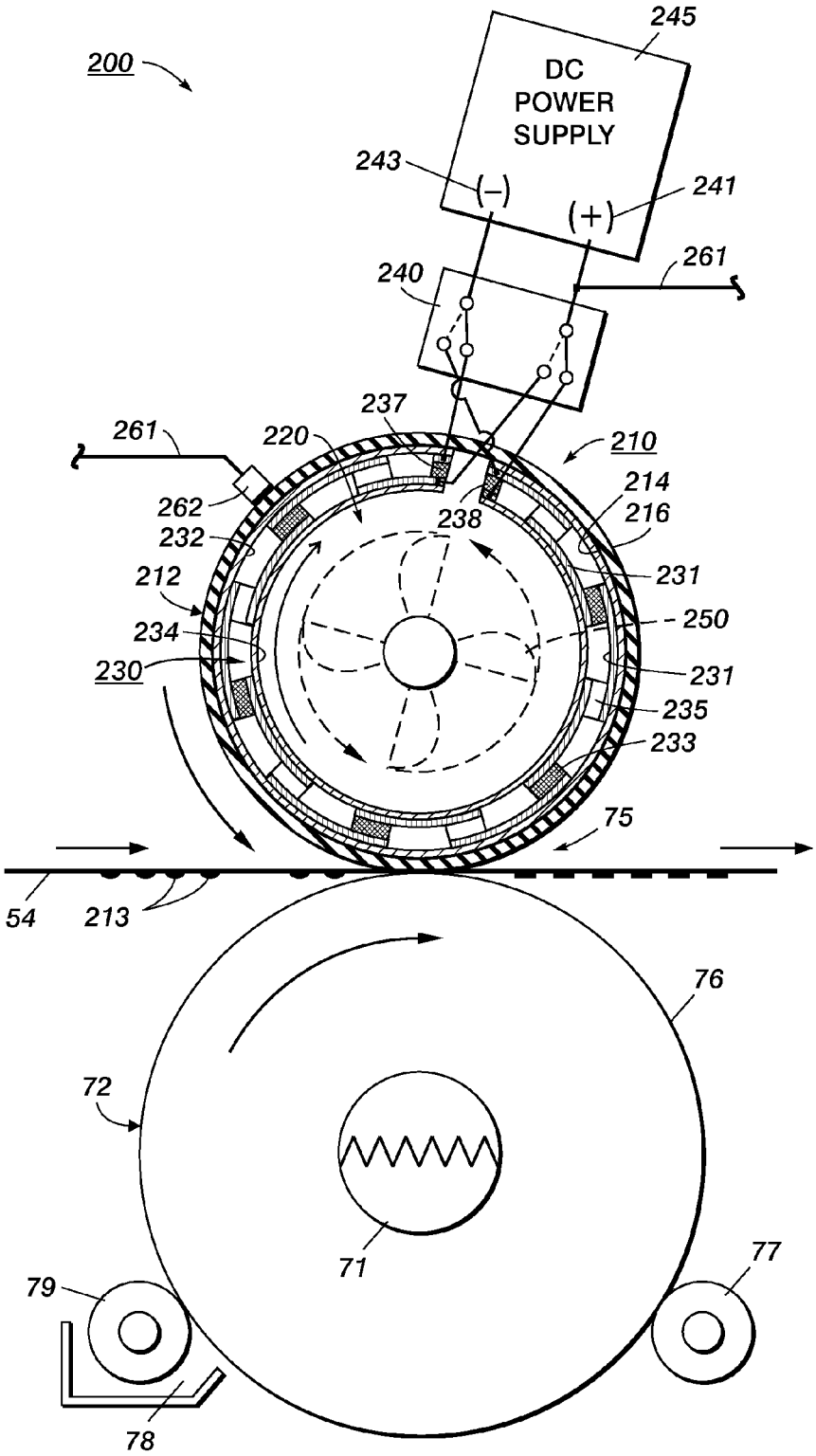
FIG. 2 is an enlarged end section schematic of the fusing apparatus of FIG. 1 showing the rapid warm-up and cool-down pressure roll assembly in accordance with the present disclosure.

Referring now to FIGS. 1-2, the fusing apparatus 70 includes a heated fuser roller 72, having a first outer surface 76, and the rapid warm-up and cool-down pressure roll assembly 200 of the present disclosure. As shown, the rapid warm-up and cool-down pressure roll assembly 200 includes a rotatable pressure roll 210 comprising a cylindrical sleeve 212 having a second outer surface 216. The second outer surface 216 of the sleeve 212 is loaded against the first outer surface 76 of fuser roller 72 forming fusing nip 75 for providing the necessary pressure to fix the heated toner powder image 213 to the copy sheet 54. The fuser roll 72 for example is internally heated by a quartz lamp 71. The fuser roll surface 76 may be cleaned by a roll 77, and release agent, stored in a reservoir 78, and pumped to a metering roll 79 for application to the surface of the fuser roll after the sheet is stripped from such surface.

As further illustrated, the rapid warm-up and cool-down pressure roll assembly 200 includes (a) the rotatable pressure roll 210 including the cylindrical sleeve 212 having the second outer surface 216, and an inner surface 214 defining a hollow interior 220 to the rotatable pressure roll; (b) a thermoelectric assembly sheet 230 positioned within the hollow interior and having a first substrate 232 facing the inner surface 214 of the cylindrical sleeve 212, a second substrate 234, an electric current flow path 236 therethrough, and electric current input and output terminals 237, 238 associated with the electric current flow path 236 and a D.C. power supply 245; and (c) an electric current input switching device 240 connected to the electric current input and output terminals 237, 238 for enabling selective reversing of a direction d1, d2 of electric current flow through the electric current flow path 236, thereby reversing which of the first substrate 232 and the second substrate 234 of the thermoelectric assembly sheet 230 is hot and which is cold, and therefore selectively enabling a rapid warm-up or rapid cool-down of the cylindrical sleeve 212 of the pressure roll. The thermoelectric assembly sheet 230 and semiconductor members 233 and semiconductor members 235 comprise the Peltier effect device.

The rapid warm-up and cool-down pressure roll assembly 200 includes an air moving device 250 associated with the hollow interior 220 for moving and flowing air 252 controllably through the hollow interior and against the second substrate 234 of the thermoelectric assembly sheet 230. The cylindrical sleeve 212 is made of a heat conductive material. In one embodiment, the first substrate 232 of the thermoelectric assembly sheet 230 is mounted into heat transfer contact with the inner surface 214 of the cylindrical sleeve. In such a case, a heat conductive adhesive may be used for binding the first substrate 232 of the thermoelectric assembly sheet 230 to the inner surface 214 of the cylindrical sleeve and the electric current input and output terminals 237, 238 each will include a sliding contact member.

In an alternate embodiment, the first substrate 232 of the thermoelectric assembly sheet 230 may be positioned spaced from the inner surface 214 of the cylindrical sleeve. In such a case, the inner surface 214 of the cylindrical sleeve 212 will be movable relative to the thermoelectric assembly sheet 230 as positioned within the hollow interior 220. In this case, electrical connection to output terminals 237, 238 is via non-moving conductors. The space between the thermoelectric assembly sheet 230 and the inner surface 214 of the cylindrical sleeve could be filled with thermally conductive fluid such oil or grease.

The rapid warm-up and cool-down pressure roll 210 includes a temperature sensor 262 located on the outer surface 216 of the cylindrical sleeve 212 and connected via 261 to the controller 29, and to the thermoelectric assembly sheet 230 for controlling operation of the thermoelectric assembly sheet 230.

Figure 3:
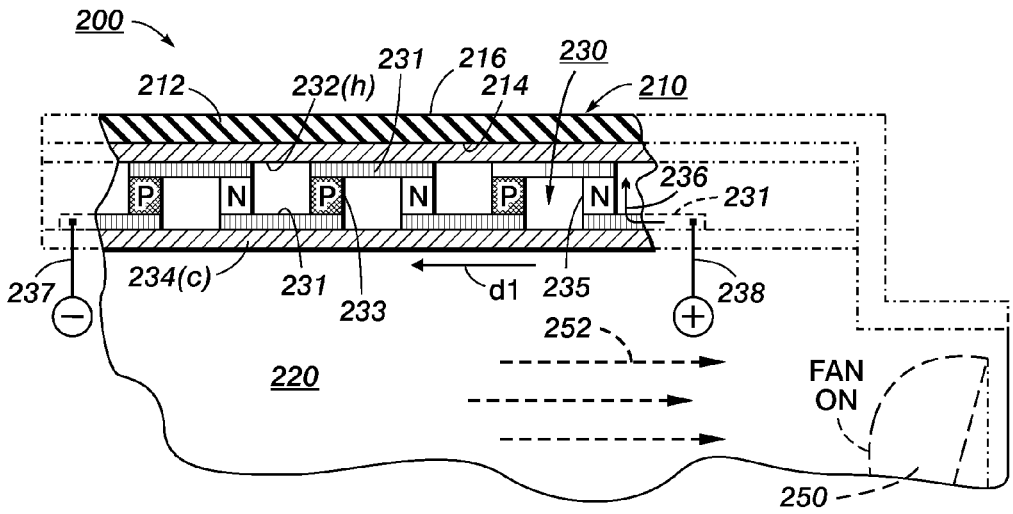
FIG. 3 is a side section in part showing the rapid warm-up and cool-down pressure roll assembly with the current flowing in a first direction in accordance with the present disclosure.
Figure 4:
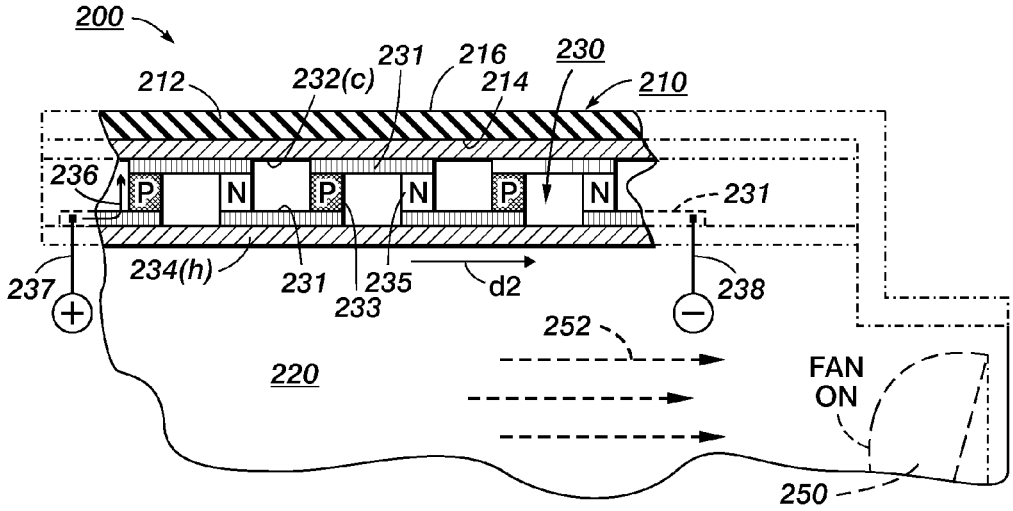
FIG. 4 is a side section in part showing the rapid warm-up and cool-down pressure roll assembly with the current flowing in a second and opposite direction in accordance with the present disclosure.

Referring now to FIGS. 3-4, which are each a side section in part of the rapid warm-up and cool-down pressure roll assembly 200 showing the current flowing in a first direction d1 (FIG. 3), and then in a second direction d2 (FIG. 4). As shown, the thermoelectric assembly sheet 230 is comprised of an arrangement of a plural number of Peltier modules using flexible substrates 232, 234 that form the first and second sides or surfaces thereof as shown. Each Peltier module is comprised of pairs of a "P" type semiconductor member 233 and an "N" type semiconductor member 235 that are mounted in combination connected by a metallic electrode 231, and spaced apart as shown between the first and second opposing substrates 232, 234 that are electrically insulating but thermally conductive. The pairs of a "P" type semiconductor member 233 and an "N" type semiconductor member 235 as mounted between the substrates connected via the current input and current output terminals 237, 238 to a source of D.C. current 245.

Referring now to FIGS. 2-4, the rapid warm-up and cool-down pressure roll assembly 200 (including the thermoelectric assembly sheet 230) is illustrated in detail. As illustrated, the rapid warm-up and cool-down pressure roll assembly 200 comprises a plural number of Peltier modules or devices that as shown each include the pair of semiconductor members 233, and 235 which are opposite to each other in conductivity type. Accordingly as shown, semiconductor member 233 is a positively doped or "p" type and semiconductor member 235 is a negatively doped or "n" type. Each of the Peltier modules or devices also includes metal electrodes 231, a pair of external substrates 232, 234 that together form the first and second external surfaces of the thermoelectric assembly sheet 230, and a pair of positive/negative power supply leads or terminals 237, 238 that are connectable to the D.C. power supply 245. Each of the substrate 232, 234 is electrically insulating, but thermally conductive.

To form the thermoelectric assembly sheet 230, the semiconductor members and the pair of external substrates 232, 234 are additionally flexible and conformable enough to be fitted to the contour of the inner surface 214 of the rotatable pressure roll 210. In the thermoelectric assembly sheet 230 of the present disclosure, the "p" type semiconductor members 233 are alternated with the "n" type semiconductor members 235 as shown.

As arranged in the thermoelectric assembly sheet 230, the semiconductor members 233, 235 and the metal electrodes 231 form Peltier junctions that are sandwiched between the external substrates 232, 234, as well as connected in series to the D.C. power supply 245 via the pair of positive/negative power supply leads or terminals 237, 238. In the thermoelectric assembly sheet 230, current will always flow from the positive terminal 241 of the D.C. power supply 245 through the series of Peltier junctions formed by the electrodes 231 and semiconductor members 233, 235 and back to the negative terminal 243 of the power supply 245. As is well known as the Peltier effect, such current flow produces a significant temperature difference between the opposite external substrates 232, 234 such that one is hot while the other is relatively cold. For example, as shown in FIG. 3, such current flow d1 is from right-to-left (positive to negative), and the temperature difference is such that the top or outer substrate 232 is the hot substrate, while the lower or inner substrate 234 is the cold substrate.

In accordance with the present disclosure, in the case shown in FIG. 3, the hot top or outer substrate 232 is adjacent to or in intimate heat transfer contact with the inner surface 214 of the cylindrical sleeve 212 of the rotatable pressure roll 210. Accordingly, when it is necessary to heat the rotatable pressure roll, the thermoelectric assembly sheet 230 (as connected to the controller 29 of the machine 8) will be operated in accordance to the illustration of FIG. 3, thereby heating the top substrate 232 and in turn the rotatable pressure roll 210.

As further illustrated, the rapid warm-up and cool-down pressure roll assembly 200 also includes an electric current input switching device 240 that is connected to the power supply 245 and switchably as shown to the input and output terminals 237, 238 for enabling selective reversing of the direction d1, d2 of electric current flow through the electric current flow path 236, thereby reversing which of the first substrate 232 and the second substrate 234 is hot and which is cold. Such reversal therefore also selectively enables a rapid warm-up or rapid cool-down of the cylindrical sleeve 212 of the pressure roll 210. Thus when input current is switched with the switching device 240, current flow d1, d2 will be reversed from what is shown in FIG. 3 to what is shown in FIG. 4, and thus will be from left-to-right (again positive to negative) and the lower or inner substrate 234 will be the hot substrate, while the outer, top substrate 232 will be the cold substrate.

Thus again in accordance with the present disclosure, the cold top or outer substrate 232 is adjacent to or in intimate heat transfer contact with the inner surface 214 of the cylindrical sleeve 212 of the rotatable pressure roll 210. Accordingly, when it is necessary to cool the rotatable pressure roll, the thermoelectric assembly sheet 230 (as connected to the controller 29 of the machine 8) will be operated in accordance to the illustration of FIG. 4, thereby cooling the top substrate 232 and in turn the rotatable pressure roll 210.

As further illustrated in FIGS. 2-4, the rapid warm-up and cool-down pressure roll assembly 200 also includes an air moving device 250 such as a fan that is connected to the controller 29, and is as well associated with the hollow interior 220 of the rotatable pressure roll 210 for moving and flowing air 252 controllably through the hollow interior and against the second substrate 234 of the thermoelectric assembly sheet 230. The air moving device 250 as such can selectively be operated to remove hot air out of the hollow interior 220 when the lower or second substrate 234 of the thermoelectric assembly sheet 230 is the hot substrate, this means hotter than the substrate 232 as well as than room temperature (FIG. 4). Moving room temperature air into and out of the hollow interior 220 when the second substrate 234 of the thermoelectric assembly sheet 230 is hotter than room temperature will reject heat from the system. It can also be operated equally to remove cold air out of the hollow interior 220 when the lower or second substrate 234 of the thermoelectric assembly sheet 230 is the cold substrate, this means colder than the substrate 232 as well as than room temperature. (FIG. 3). Moving room temperature air into and out of the hollow interior 220 when the second substrate 234 of the thermoelectric assembly sheet 230 is colder than room temperature will add heat to the system.

Accordingly, the current flow d1, d2 of the thermoelectric assembly sheet 230 can be set so that the pressure roll 210 is heated during preliminary or initial start up before the fusing apparatus produces a first print. The current flow d1, d2 can also be switched by means of the device 240 and set so that the pressure roll 210 is cooled during duplexing operations in order to prevent over-fusing related image defects.

As can be seen, there has been provided a rapid warm-up and cool-down pressure roll assembly that includes (a) a rotatable pressure roll including a cylindrical sleeve having an outer surface, and an inner surface defining a hollow interior to the rotatable pressure roll; (b) a thermoelectric assembly sheet positioned within the hollow interior and having a first substrate facing the inner surface of the cylindrical sleeve, a second substrate, an electric current flow path therethrough, and electric current input and output terminals associated with the electric current flow path; and (c) an electric current input switching device connected to the electric current input and output terminals for enabling selective reversing of a direction of electric current flow through the electric current flow path, thereby reversing which of the first substrate and the second substrate of the thermoelectric assembly sheet is hot and which is cold, and therefore selectively enabling a rapid warm-up or rapid cool-down of the cylindrical sleeve of the pressure roll.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A rapid warm-up and cool-down pressure roll assembly comprising:

(a) a rotatable pressure roll including a cylindrical sleeve having an outer surface for contacting a surface of a sheet opposite to a surface of the sheet on which an image is formed, and an inner surface defining a hollow interior to said rotatable pressure roll, said cylindrical sleeve being made entirely of a heat conductive material;

(b) a thermoelectric assembly sheet positioned within the hollow interior of the rotatable pressure roll, the thermoelectric assembly sheet having a Peltier effect device positioned within said hollow interior and having a cylindrical first substrate, a cylindrical second substrate opposite and spaced radially inward from said first substrate, an electric current flow path therethrough, and electric current input and output terminals associated with said electric current flow path, said first substrate facing said inner surface of said cylindrical sleeve, and said second substrate redefining said hollow interior, the thermoelectric assembly sheet having a plurality of pairs of a p-type semiconductor member and an n-type semiconductor member spaced apart from each other along an axis of rotation between the first substrate and the second substrate, the p-type semiconductor member and the n-type semiconductor member connected by an electrode, each pair of p-type semiconductor member and n-type semiconductor member connected to another pair of p-type semiconductor member and n-type semiconductor member along the axis of rotation by an electrode, the pairs of p-type semiconductor members and n-type semiconductor members coupled via the electric current input and output terminals to an electric current source; and (c) an electric current input switching device connected to said electric current input and output terminals to selectively reverse a direction of electric current flow through said electric current flow path, thereby reversing which of said first substrate and said second substrate of said Peltier effect device is hot and which is cold, and therefore selectively rapidly warming up and rapidly cooling down said cylindrical sleeve of said pressure roll by said Peltier effect device, wherein the first substrate of the thermoelectric assembly sheet is positioned spaced from the inner surface of the cylindrical sleeve such that said inner surface of said cylindrical sleeve is movable relative to said Peltier effect device as positioned within said hollow interior and the electric current input and output terminals do not move relative to said Peltier effect device as positioned within said hollow interior.

2. The rapid warm-up and cool-down pressure roll assembly of claim 1, including an air moving device associated with said hollow interior for moving and flowing air controllably through said hollow interior and against said second substrate of said Peltier effect device, where the air moving device removes hot air out of the cylindrical sleeve hollow interior when the cylindrical second substrate is hotter than the cylindrical first substrate to reject heat from the pressure roll assembly and removes cold air out of the cylindrical sleeve hollow interior when the cylindrical second substrate is colder than the cylindrical first substrate to add heat to the pressure roll assembly.

3. The rapid warm-up and cool-down pressure roll of claim 1, wherein said first substrate of said Peltier effect device is mounted into heat transfer contact with said inner surface of said cylindrical sleeve.

4. The rapid warm-up and cool-down pressure roll of claim 1, wherein said first substrate of said Peltier effect device is positioned spaced from said inner surface of said cylindrical sleeve.

5. The rapid warm-up and cool-down pressure roll of claim 1, wherein each of said first substrate and said second substrate is flexible.

6. The rapid warm-up and cool-down pressure roll of claim 1, including a temperature sensor located on said outer surface of said cylindrical sleeve for controlling operation of said Peltier effect device.

7. The rapid warm-up and cool-down pressure roll of claim 1, each of said first substrate and said second substrate is electrically insulative and thermally conductive.

8. The rapid warm-up and cool-down pressure roll assembly of claim 1, wherein the pressure roll assembly heats the pressure roll during initial start up to heat the pressure roll before producing a first print and the pressure roll assembly cools the pressure roll during duplex operations to prevent over-fusing related image defects.

9. A toner fusing apparatus comprising:

(a) a movable heated fuser roll having a first outer surface; and (b) a rapid warm-up and cool-down pressure roll assembly including:

(i) a rotatable pressure roll including a cylindrical sleeve having a second outer surface forming a fusing nip against said first outer surface of said movable heated fuser roll, and an inner surface defining a hollow interior to said rotatable pressure roll, said first outer surface contacting an image on a surface of a sheet received at the fusing nip and said second outer surface contacting a surface of the sheet opposite to the surface on which the image is disposed;

(ii) a thermoelectric assembly sheet positioned within the hollow interior of the rotatable pressure roll, the thermoelectric assembly sheet having a Peltier effect device positioned within said hollow interior and having a cylindrical first substrate, and a cylindrical second substrate opposite and spaced radially inward from said first substrate, an electric current flow path therethrough, and electric current input and output terminals associated with said electric current flow path, said first substrate facing said inner surface of said cylindrical sleeve, and said second substrate redefining said hollow interior, the thermoelectric assembly sheet having a plurality of pairs of a p-type semiconductor member and an n-type semiconductor member spaced apart from each other along an axis of rotation between the first substrate and the second substrate, the p-type semiconductor member and the n-type semiconductor member connected by an electrode, each pair of p-type semiconductor member and n-type semiconductor member connected to another pair of p-type semiconductor member and n-type semiconductor member along the axis of rotation by an electrode, the pairs of p-type semiconductor members and n-type semiconductor members coupled via the electric current input and output terminals to an electric current source; and (iii) an electric current input switching device connected between the electric current input and output terminals and the electric current source to selectively reverse a direction of electric current through said electric current flow path, thereby reversing which of said first substrate and said second substrate is hot and which is cold, and therefore selectively rapidly warming up and rapidly cooling down said cylindrical sleeve of said pressure roll by said Peltier effect device, wherein the first substrate of the thermoelectric assembly sheet is positioned spaced from the inner surface of the cylindrical sleeve such that said inner surface of said cylindrical sleeve is movable relative to said Peltier effect device as positioned within said hollow interior and the electric current input and output terminals do not move relative to said Peltier effect device as positioned within said hollow interior.

10. The toner fusing apparatus of claim 9, including a temperature sensor mounted on said outer surface of said cylindrical sleeve for controlling operation of said Peltier effect device.

11. The toner fusing apparatus of claim 9, wherein each of said first substrate and said second substrate is electrically insulative and thermally conductive.

12. The toner fusing apparatus of claim 9, wherein said first substrate of said Peltier effect device is mounted into heat transfer contact with said inner surface of said cylindrical sleeve.

13. The toner fusing apparatus of claim 9, including an air moving device associated with said hollow interior for moving and flowing air controllably through said hollow interior and against said second substrate of said Peltier effect device.

14. The toner fusing apparatus of claim 9, wherein said cylindrical sleeve is made entirely of a heat conductive material.

15. An electrostatographic reproduction machine comprising:

(a) a moveable imaging member including an imaging surface;

(b) latent imaging means for forming a latent electrostatic toner image on said imaging surface of said moveable imaging member;

(c) a development apparatus mounted adjacent a path of movement of said moveable imaging member for developing said latent electrostatic image on said imaging surface into a toner image;

(d) a transfer station for transferring said toner image from said imaging surface onto a toner image carrying sheet;

(e) a movable heated fuser roll having a first outer surface;

(f) a rapid warm-up and cool-down pressure roll assembly comprising:

(i) a rotatable pressure roll including a cylindrical sleeve having a second outer surface forming a fusing nip against said first outer surface of said movable heated fuser roll, and an inner surface defining a hollow interior to said rotatable pressure roll, said first outer surface contacting an image on a surface of a sheet received at the fusing nip and said second outer surface contacting a surface of the sheet opposite to the surface on which the image is disposed;

(ii) a thermoelectric assembly sheet positioned within the hollow interior of the rotatable pressure roll, thermoelectric assembly sheet having a Peltier effect device positioned within said hollow interior and having a cylindrical first substrate, a cylindrical second substrate opposite and spaced radially inward from said first substrate, an electric current flow path therethrough, and electric current input and output terminals associated with said electric current flow path, said first substrate facing said inner surface of said cylindrical sleeve, and said second substrate redefining said hollow interior, the thermoelectric assembly sheet having a plurality of pairs of a p-type semiconductor member and an n-type semiconductor member spaced apart from each other along an axis of rotation between the first substrate and the second substrate, the p-type semiconductor member and the n-type semiconductor member connected by an electrode, each pair of p-type semiconductor member and n-type semiconductor member connected to another pair of p-type semiconductor member and n-type semiconductor member along the axis of rotation by an electrode, the pairs of p-type semiconductor members and n-type semiconductor members coupled via the electric current input and output terminals to an electric current source; and (iii) an electric current input switching device connected to said electric current input and output terminals to selectively reverse a direction of electric current through said electric current flow path, thereby reversing which of said first substrate and said second substrate is hot and which is cold, and therefore selectively rapidly warming up and rapidly cooling down said cylindrical sleeve of said pressure roll by said Peltier effect device, wherein the first substrate of the thermoelectric assembly sheet is positioned spaced from the inner surface of the cylindrical sleeve such that said inner surface of said cylindrical sleeve is movable relative to said Peltier effect device as positioned within said hollow interior and the electric current input and output terminals do not move relative to said Peltier effect device as positioned within said hollow interior.

16. The electrostatographic reproduction machine of claim 15, including an air moving device associated with said hollow interior for moving and flowing air controllably through said hollow interior and against said second substrate of said Peltier effect device.

17. The electrostatographic reproduction machine of claim 15, wherein said cylindrical sleeve is made entirely of a heat conductive material.

18. The electrostatographic reproduction machine of claim 15, wherein said first substrate of said Peltier effect device is mounted into heat transfer contact with said inner surface of said cylindrical sleeve.

19. The electrostatographic reproduction machine of claim 15, wherein each of said first substrate and said second substrate is electrically insulative and thermally conductive.

* * * * *